US006134725A

United States Patent [19]

Bouhuijs

[11] Patent Number: 6,134,725

[45] Date of Patent: Oct. 24, 2000

[54] DEVICE AND METHOD FOR RAISING OR MOVING A PERSON

[75] Inventor: Menno Cornelis Bouhuijs, Hengelo, Netherlands

[73] Assignee: Careflex Holding B.V., Netherlands

[21] Appl. No.: 09/228,400

[22] Filed: Jan. 12, 1999

Related U.S. Application Data

[63] Continuation of application No. 08/913,126, Sep. 9, 1997, Pat. No. 5,878,450.

[30] Foreign Application Priority Data

Mar. 10, 1995 [NL] Netherlands ..... 9500482

[51] Int. Cl.[7] ..... A61G 7/10; A61G 7/12

[52] U.S. Cl. ..... 5/86.1

[58] Field of Search ..... 5/86.1, 83.1, 81.1 R, 5/89.1

[56] References Cited

U.S. PATENT DOCUMENTS

| | | | |
|---|---|---|---|
| 2,747,652 | 5/1956 | Marsh . | |
| 3,189,345 | 6/1965 | Simpson | 272/70.4 |
| 3,277,502 | 10/1966 | Wauthier | 5/81.1 R |
| 3,623,169 | 11/1971 | James | 5/81.1 R |
| 3,629,380 | 12/1971 | Van Rhyn | 5/86 |
| 3,996,632 | 12/1976 | Bakker nee Viel | 5/83 |
| 4,028,752 | 6/1977 | Oerthel | 5/81.1 R |
| 4,682,377 | 7/1987 | Reich | 5/86 |
| 4,703,523 | 11/1987 | James | 5/83 |
| 4,712,257 | 12/1987 | James | 5/83 |
| 4,837,874 | 6/1989 | Giercarz et al. | 5/83 |
| 4,918,771 | 4/1990 | James | 5/86.1 |
| 5,001,789 | 3/1991 | Schoenberger . | |
| 5,022,106 | 6/1991 | Richards | 5/86 |
| 5,117,516 | 6/1992 | Penner | 5/86 |
| 5,309,584 | 5/1994 | Parker | 5/86.1 |
| 5,365,621 | 11/1994 | Blain | 5/81.1 R |
| 5,459,891 | 10/1995 | Reeve et al. | 5/87.1 |
| 5,644,805 | 7/1997 | Horcher | 5/86.1 |

FOREIGN PATENT DOCUMENTS

| | | |
|---|---|---|
| 0 547 901 A1 | 6/1993 | European Pat. Off. . |
| 2140773 | 12/1984 | United Kingdom . |

*Primary Examiner*—Alexander Grosz
*Attorney, Agent, or Firm*—Joseph P. Gastel; Elliott I. Pollock

[57] ABSTRACT

A method of moving a person to a standing position from a seated position on a seat including the steps of providing an attachment member for engagement with the person, moving the person who is connected to the attachment member slightly upwardly and thereafter in an essentially horizontal direction, and thereafter moving the person in an essentially vertical direction to a standing position, returning the person from a standing position to the seated position by moving the person essentially horizontally to above the seat, and then moving the person essentially vertically onto the seat. The method also includes steps of counting or recording the number of times the person has been moved from one to the other of the seated and standing positions, and storing the identity of the person that has been so moved.

9 Claims, 4 Drawing Sheets

1
8
13
7
4
16
19
3
21
18
10
11
12
2
15

DEVICE AND METHOD FOR RAISING OR MOVING A PERSON

CROSS REFERENCE TO RELATED APPLICATION

This application is a continuation of U.S. patent application Ser. No. 08/913,126 filed Sep. 9, 1997 now U.S. Pat. No. 5,878,450.

The present invention relates to a device for raising or moving a person from a seated position into a standing position or vice versa, comprising a frame which is movable on wheels, to which frame a lifting arm is fitted, which frame is hingeable essentially about a horizontal axis and is provided with gripping means for said person.

A device of this type is disclosed in the Dutch Application laid open for opposition purposes 190 471.

The latter publication describes an essentially vertical frame on which the lifting arm is hingeably mounted. With this arrangement it is essential that the length of the lifting arm corresponds to the length of the femur of the person concerned. By turning the lifting arm with respect to the frame, the person can be raised. With this arrangement, it is assumed that a sort of parallelogram construction is produced, two sides of the parallelogram being formed by, on one side, the lifting arm and, on the other side, the femur of the patient.

It has been found that a lifting movement of this type is unnatural, offers no possibilities for providing adjustment to suit persons who still have some strength to stand up on their own and is unsuitable for rehabilitation purposes. Moreover, problems arise with people of different heights.

The aim of the present invention is to provide a device which does not have these disadvantages.

This aim is achieved in the case of a device as described above in that one end of an auxiliary arm is fixed to the frame such that it is hingeable about an essentially horizontal axis, the lifting arm being fixed to the other end of the auxiliary arm such that it is hingeable about an essentially horizontal axis and means being provided for controlling the movement of the lifting arm from the frame.

The invention is based on the insight of replacing the lifting arm by an articulated construction consisting of the lifting arm and an auxiliary arm connected thereto. The auxiliary arm, in turn, is connected to the frame. In this way it is possible to execute a large number of different movements at the ends of the lifting arm, which is gripped by the patient. Such gripping can take place either by attachment means such as grab bars or a strap which is fastened to the ends of the lifting arm, or by both said means.

As a result of the articulated construction it is, for example, possible when raising a person from a seated position first to let said person move essentially forwards towards the device and then move essentially upwards, that is to say in the vertical direction.

This is in contrast to the device according to the above mentioned Netherlands Application for opposition purposes 190 471, in which the first part of the movement will always be essentially vertical or, in an extreme case, horizontal in the direction away from the device.

The movement which is possible using the device according to the invention is much more natural and stimulates the person concerned to cooperate in being raised, so that his or her muscle function is maintained and/or trained as far as possible.

Moreover, this construction offers the possibility of following a different path when moving from the standing position into the seated position. In such a case it is possible for the patient first to be moved from the standing position horizontally to above the seat and then be moved vertically.

It must be understood that numerous other seated/standing/seated paths are also possible with the construction according to the invention.

The means for controlling the movement of the lifting arm from the frame preferably comprise a rod transmission. Because said rod transmission will in practice largely be under tensile stress, a more flexible transmission is likewise possible. Preferably, a safety device is fitted to prevent the person from being trapped between the arm and his or her chair.

If a rod transmission is used, two rods hingeably connected to one another are preferably fitted, one of said rods being pivotably mounted in the hinge point of the auxiliary arm in the frame. In this way the force needed to move the lifting arm essentially bypasses the auxiliary arm. Consequently, independent movement of auxiliary arm and lifting arm is relatively simple to achieve because movement of the one arm has no effect on the operating force on the other arm.

The arms can be controlled by operating elements such as motors. The motors are preferably of such construction that the movement generated by the motors is actually recorded. The various features can be controlled via a central control unit, such as a programmable logic controller, also known as a PLC. With a control of this type it is possible to incorporate various paths. It is also possible to vary the force with which the motors are operated. After all, for rehabilitation purposes it is important that the seated person is trained to use at least some of his or her own strength to stand up. By designing the various features in such a way that the lifting force is limited, such a person is stimulated to use his or her own strength. Moreover, it is possible to allow the motors to operate at various speeds, optionally depending on the response from the person concerned.

A further possibility which may be mentioned is design of the control unit in such a way that the control begins the movement path at the point in time when the motors are subjected to a resisting force, that is to say at the point in time at which the device has "taken up the strain". That is to say an accurately defined lifting path is always executed from the start of lifting irrespective of the position of the seated person with respect to the lifting device.

Preferably, knee supports are provided, against which the person can support him- or herself while being raised. Preferably, these supports are mounted such that they are flexible with respect to the frame.

According to a further advantageous embodiment, the device according to the present invention is provided with read-out means. This enables the activities carried out by the device to be read out at a central location. This can take place with the aid of a connector or can also be effected by cordless means. The device can furthermore be provided with means for patient-specific read-out of the activities executed by the device.

The invention will be explained in more detail below with reference to an illustrative embodiment of the invention shown in the drawings. In the drawings.

Figure 1:
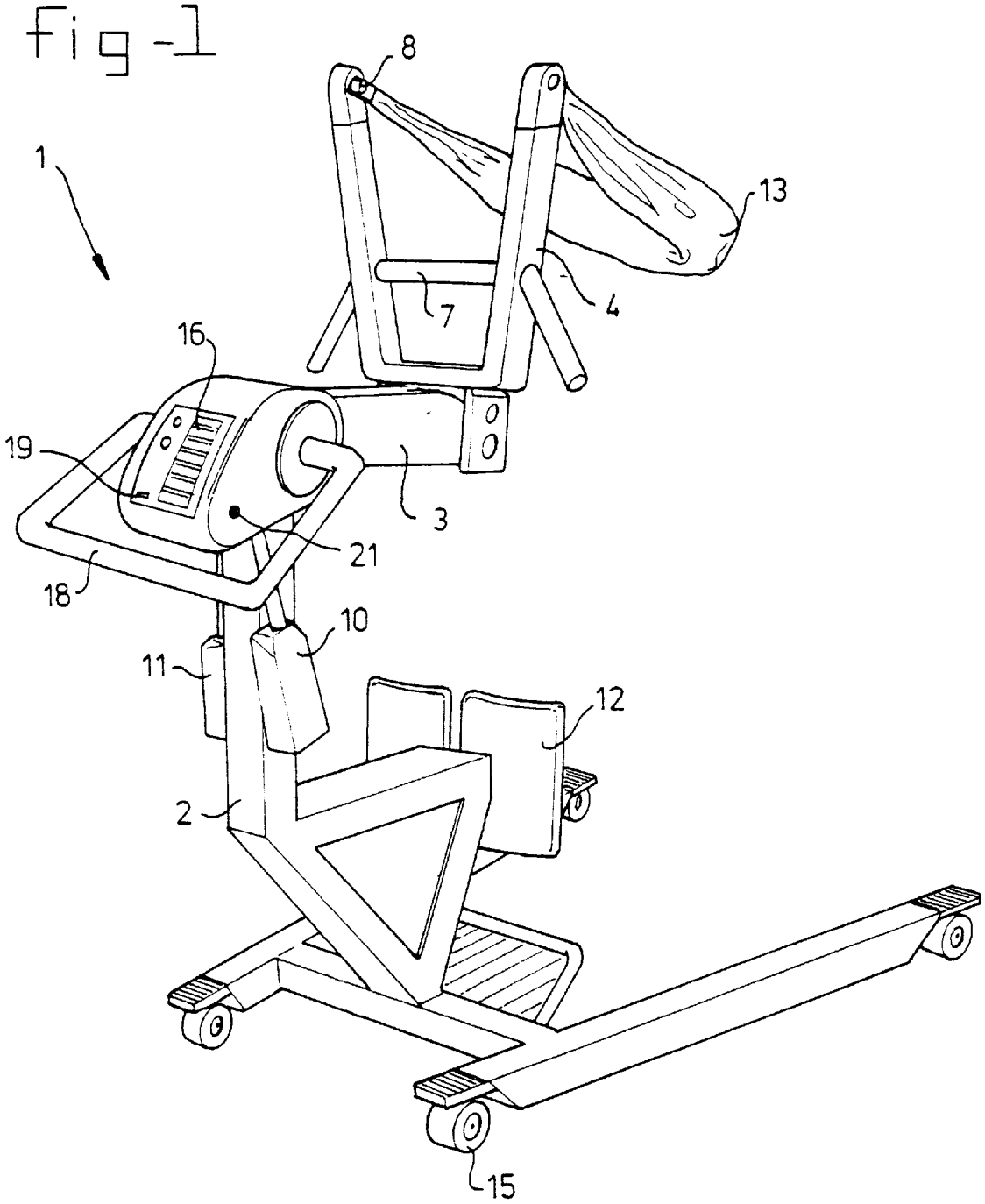
FIG. 1 shows a perspective view of the device according to the invention.
Figure 4:
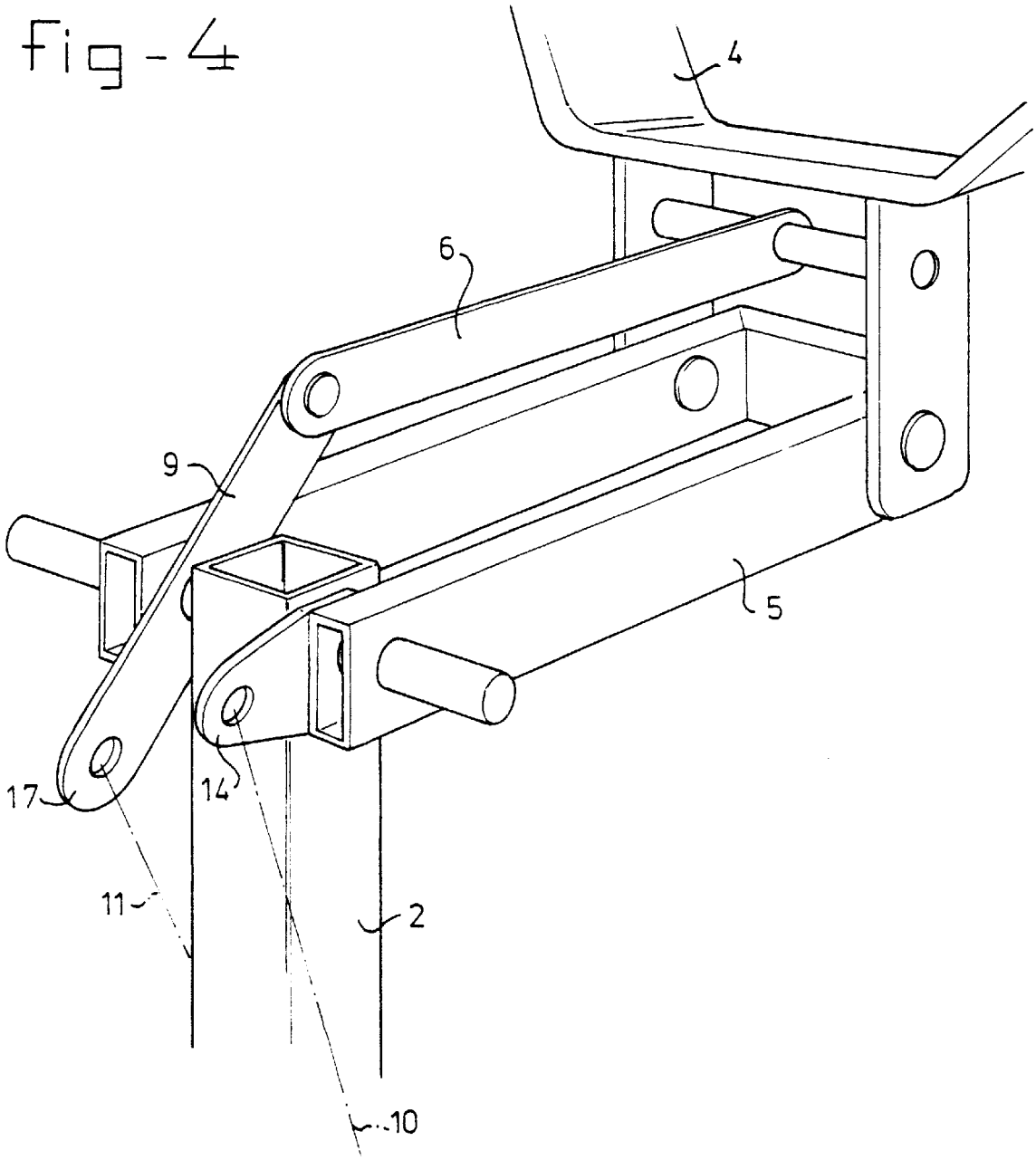
FIG. 4 shows a detail of the lifting arm/auxiliary arm assembly.

In FIG. 1 the device according to the invention is indicated in its entirety by 1. This device consists of a frame 2, which is moved on castors 15. That part of frame 2 which extends vertically is constructed such that it is offset somewhat to the left in connection with the presence of auxiliary arm 5. This auxiliary arm 5 is shown in more detail in FIG. 4. Only cover 3, which covers both auxiliary arm 5 and rod 6, is visible in FIG. 1. Comparison of FIGS. 1 and 4 shows that this auxiliary arm 5 is hingedly or pivotally attached to frame 2. Lifting arm 4 is hingedly or pivotally attached to the other free end of auxiliary arm 5. Lifting arm 4 is likewise hingedly or pivotally connected to rod 6. It can be seen from FIG. 1 that the lifting arm 4 is provided with grab bars 7 as well as fixings 8 for a support belt 13, which is indicated diagrammatically. This support belt 13 can be unhooked from the fixings 8.

The other, free end of rod 6 is hingedly or pivotally connected to rod 9. This rod 9 pivots about a hinge or pivot which is coincident with the hinge or pivot for auxiliary arm 5 with frame 2. The free end of auxiliary arm 5, which is indicated by 14, and the free end of rod 9, which is indicated by 17, are connected to a motor 10 and 11 respectively, as can be seen from FIG. 1. It can also be seen from FIG. 1 that a pull bar 18 is provided, as well as a console 19 in which various control instruments are housed. There is a control unit 16 inside console 19. Display means can also be provided on console 19.

A set of knee supports 12 is also mounted on frame 2. These knee supports are fixed such that they are flexible with respect to the frame, for example by fixing blocks of flexible material, such as rubber blocks, between knee supports and frame. These blocks are indicated diagrammatically by 20 in FIG. 2.

By controlling the motors 10 and 11 it is possible to move auxiliary arm 5 and lifting arm 4 independently of one another. Moreover, the construction of the rod transmission 6, 9 ensures that the force which acts on lifting arm 4 is essentially taken up by motor 11, so that motor 10 only has to have a rating which is appropriate for moving auxiliary arm 5 and that motors 10 and 11 are subjected to approximately equal loads.

The position of the auxiliary arm and lifting arm can be determined with the aid of counter devices fitted in the motors 10 and 11, which counter devices record the number of revolutions. These motors can be, for example, electric motors powered by a battery, which is not shown in more detail, these motors operating the relevant arms with the aid of a worm/nut mechanism. A read-out connector is indicated by 21.

An example of raising a patient from a seated position, shown in FIG. 2, into a standing position, shown in FIG. 3, will be given below.

Figure 2:
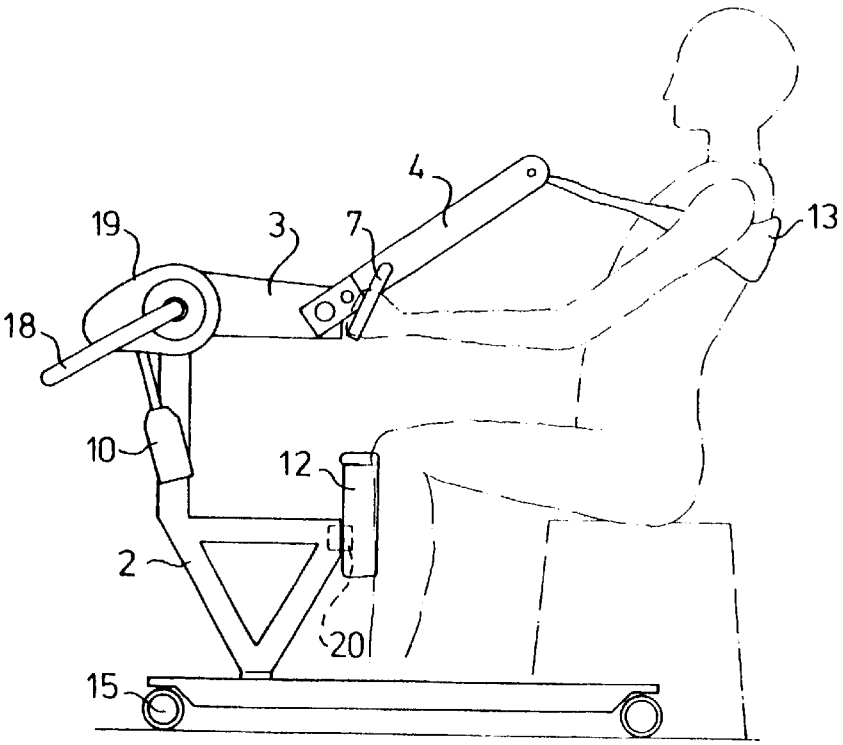
FIG. 2 shows a side view of the device in use with a seated person.

Starting from the situation shown in FIG. 2, lifting arm 4 will be pivoted to the left by means of motor 11 until motor 11 is subjected to a reaction force due to the weight of the seated person. At that point in time the controller will be set to the 0 position and the program from the specific movement path will be started. This movement path can be determined on console 19. It is also possible to fit a remote control. Starting from the "strain taken up" position shown in FIG. 2, the seated person will be moved slightly upwards and moved towards the device in an essentially horizontal direction by further pivoting of the lifting arm 4, possibly corrected by a movement of auxiliary arm 5.

Depending on the condition of the person concerned, the horizontal forward movement will be continued. If the related person no longer has any muscle strength at all, the forward movement will be less pronounced than in the case of persons who have some residual strength. Following said horizontal movement, the person will be moved upwards by interaction of auxiliary arm and lifting arm until the person ultimately assumes the position shown in FIG. 3.

When sitting down again, the person concerned will first be moved horizontally in the direction away from the machine and then subjected to a lowering movement, in contrast to the movement described above.

This procedure prevents the knees of the person concerned from "locking up" when sitting down.

Using the device according to the invention it is possible to carry out lifting at different speeds.

During this movement the person can be supported by the support belt and/or hold onto grab bars 7.

Figure 3:
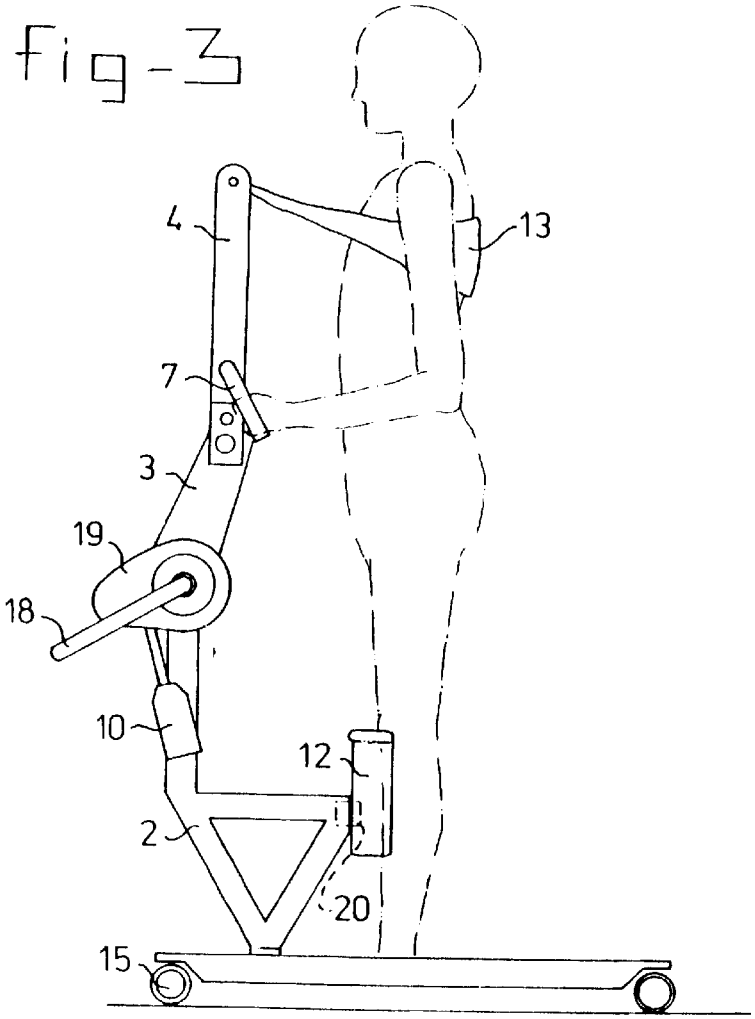
FIG. 3 shows a side view of the device with the person in the standing position.
Figure 5:
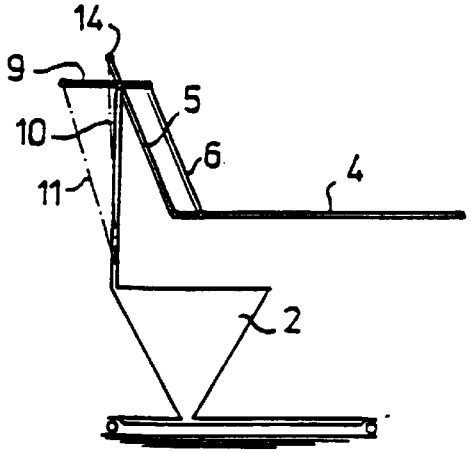
FIGS. 5–7 show, diagrammatically, various positions of lifting arm/auxiliary arm and rod transmission.
Figure 6:
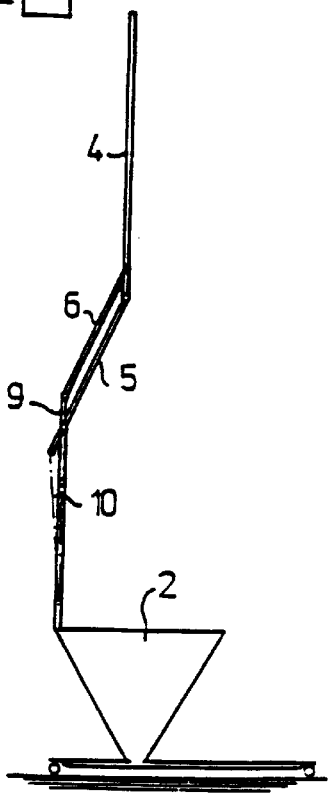
Figure 7:
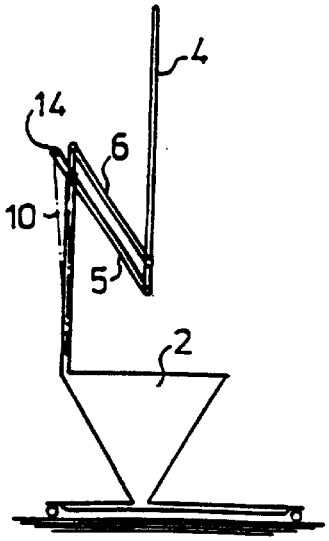

FIGS. 5–7 show the device in various positions corresponding to FIGS. 2 and 3 and a storage position.

It can be seen from the above that it is possible, using the device described above, to match the pattern of movement to the individual using the device.

Furthermore, it is possible to provide the device with a memory in which the operations carried out therewith can be saved. A memory of this type can be made patient-dependent. By providing a connection to a central computer, which, for example, comprises the read-out connector 21, it is possible to establish from a central location by whom and to what extent use has been made of the device concerned. If, for example, the device is used in a toilet, it is possible to establish how frequently which persons have made use of that toilet. It is also possible to establish how often the device described above is used.

If the data read out are patient-dependent, it is possible to establish whether a patient is making more or less use of the device. This can indicate an improvement or a deterioration in condition. In this way a more objective determination of the state of health of the patient can be obtained than is possible on the basis of different assessments by various members of the nursing staff.

Of course, it is also possible using this type of read-out to establish the extent to which the device has been subject to malfunctions and the like.

It must be understood that a read-out of this type, especially where this is carried out with the aim of patient-specific read-out relating to the use of the device according to the invention, can also be employed with other raising lifts or equipment used in the medical world.

Although the invention has been described above with reference to a preferred embodiment, it will be understood that numerous modifications can be made thereto which are obvious variants of the principle of the invention. This principle is described in the appended claims and comprises an articulated construction of the lifting arm/auxiliary arm, as a result of which it is no longer necessary to maintain the purely circular movement according to the prior art.

I claim:

1. A method of moving a person to a standing position from a seated position on a seat comprising the steps of providing an attachment member for engagement with said person, moving the person who is connected to the attachment member slightly upwardly and horizontally and thereafter moving the person in an essentially vertical direction to a standing position.

2. A method as set forth in claim 1, including the steps of returning the person from a standing position to said seated position by moving the person essentially horizontally to above the seat, and then moving the person essentially vertically onto the seat.

3. The method of claim 2 including the step of counting the number of times the method has been performed to move a person from a standing position to a seated position.

4. The method of claim 2 including the step of recording the number of times the method has been performed to move a person from a standing position to a seated position.

5. The method of claim 1 or 2 including the step of storing the identity of the person that has been moved from one to the other of said seated and standing positions.

6. The method of claim 1 including the step of counting the number of times the method has been performed to move a person from a seated position to a standing position.

7. The method of claim 1 including the step of recording the number of times the method has been performed to move a person from a seated position to a standing position.

8. A method of moving a person to a standing position from a seated position on a seat comprising the steps of providing an attachment member for engagement with said person, moving the person who is connected to the attachment member essentially horizontally and thereafter moving the person in an essentially vertical direction to a standing position.

9. A method as set forth in claim 8 including the steps of returning the person from a standing position to said seated position by moving the person essentially horizontally during the first part of the movement, and lowering the person essentially vertically during the second part of the movement.

* * * * *